US006726786B1

(12) United States Patent
Bode et al.

(10) Patent No.: US 6,726,786 B1
(45) Date of Patent: Apr. 27, 2004

(54) PROCESS FOR THE PRODUCTION OF STOVE-FINISHED STRUCTURAL COMPONENTS FROM AGEING-SENSITIVE STEEL

(75) Inventors: Rolf Bode, Wesel (DE); Ilse Heckelmann, Xanten (DE)

(73) Assignee: Thyssen Krupp Stahl AG, Duisburg (DE)

( * ) Notice: Subject to any disclaimer, the term of this patent is extended or adjusted under 35 U.S.C. 154(b) by 0 days.

(21) Appl. No.: 09/508,490

(22) PCT Filed: Aug. 4, 1998

(86) PCT No.: PCT/EP98/04845

§ 371 (c)(1),
(2), (4) Date: Mar. 10, 2000

(87) PCT Pub. No.: WO99/14384

PCT Pub. Date: Mar. 25, 1999

(30) Foreign Application Priority Data

Dec. 9, 1997 (DE) ..... 197 40 148

(51) Int. Cl.[7] ..... C21D 8/00
(52) U.S. Cl. ..... 148/577; 148/661
(58) Field of Search ..... 148/578

(56) References Cited

U.S. PATENT DOCUMENTS

| | | | | |
|---|---|---|---|---|
| 3,537,913 A | | 11/1970 | Klisowski | |
| 3,909,311 A | | 9/1975 | Yamada et al. | |
| 4,050,959 A | * | 9/1977 | Nakaoka et al. | 148/12.3 |
| 4,323,403 A | * | 4/1982 | Nakaoka et al. | 148/601 |
| 4,358,325 A | * | 11/1982 | Stevenson | 148/125 |

FOREIGN PATENT DOCUMENTS

| | | |
|---|---|---|
| DE | 32 21 840 | 10/1983 |
| DE | 35 28 782 | 4/1987 |
| DE | 38 41 870 | 6/1990 |
| DE | 196 22 164 | 5/1997 |
| EP | 0 216 399 | 4/1987 |
| EP | 0 703 298 | 3/1996 |
| GB | 1051307 | 12/1966 |

OTHER PUBLICATIONS

"Metals Handbook: vol. 1 Properties and Selection: Irons, Steels, and High–Performance Alloys", 10$^{th}$ Ed., ASM International, 1990, pp. 141–146,204–208,212–215,573–575, 578–580.*

"The Making, Shaping, and Treating of Steel", 10$^{th}$ Ed., Association of Iron and Steel Engineers, 1985, pp 410–413, 1118–1119, 1135–1138,1283–1287,1398–1404.*

* cited by examiner

*Primary Examiner*—Roy King
*Assistant Examiner*—Janelle Combs Morillo
(74) *Attorney, Agent, or Firm*—Proskauer Rose LLP

(57) ABSTRACT

The invention relates to processes for the production of a buckling-resistant stove-finished structural member from cold rolled and dressed strip (cold strip) non-ageing steel with high bake-hardening potential, more particularly of more than 70 N/mm$^2$. The characterising feature of the invention is that the cold strip is converted by dressing into a yield point stretch-free state ($R_{eh}$–$R_{el}$<2 N/mm$^2$), then stored at a temperature below room temperature and further processed into the form of a structural member, whereafter the strip is finally stove finished.

3 Claims, 1 Drawing Sheet

Figure 1:
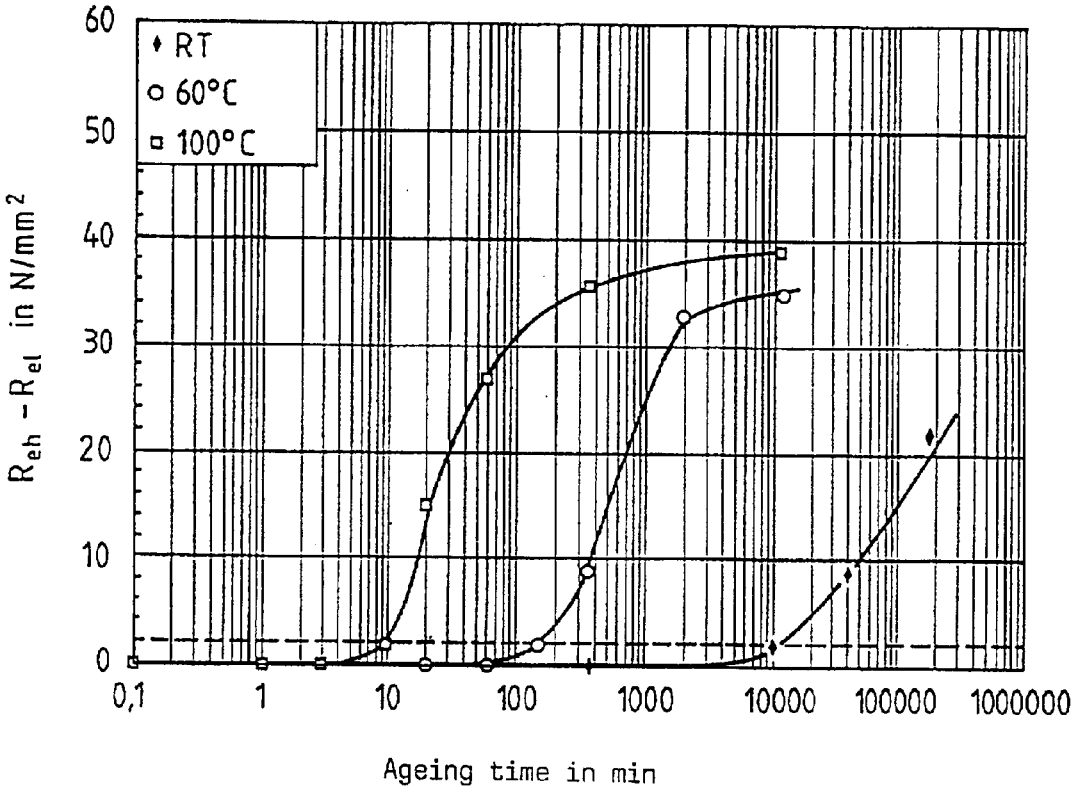

PROCESS FOR THE PRODUCTION OF STOVE-FINISHED STRUCTURAL COMPONENTS FROM AGEING-SENSITIVE STEEL

The invention relates to a process for the production of a buckling-resistant stove-finished structural member from cold rolled and dressed strip (cold strip) from non-ageing steel with high bake-hardening potential, more particularly of more than 70 N/mm$^2$.

To achieve a high bake-hardening potential as a rule use is made of steels which contain dissolved nitrogen as well as dissolved carbon. Examples of these are unkilled steels. The storage of strips of such steels at room temperature leads even after the short time of one or two days to ageing processes which make impossible any satisfactory further processing, more particularly cold working. There is also an adverse effect on the surface texture of the cold strips.

Ageing can be caused by the diffusion of dissolved carbon and/or nitrogen. In the case of pure carbon ageing the effect of temperature on ageing time can be estimated as follows: The times $t_1$ and $t_2$ required for identical ageing effects stand in converse ratio to the associated temperature-dependent coefficients of diffusion of carbon in $\alpha$ iron.

In the temperature range up to 100° C. we therefore have $$t_1(T_1)/t_2(T_2) = D(T_2)/D(T_1) = \frac{\exp(-21.1/(1,987\cdot 10^{-3}\cdot T_2)}{\exp(-21.1/(1,987\cdot 10^{-3}\cdot T_1)} \quad [1]$$

with $T_{1,2}$ in K.

Table 1 shows the factors calculated according to equation [1] for the delay in time of an ageing effect due to lowered temperatures. For example, in comparison with ageing at room temperature, ageing at −10° C. lengthens ageing time by 62 times.

TABLE 1

| Ageing temperature (° C.) | 10 | 5 | 0 | −5 | −10 |
|---|---|---|---|---|---|
| Factor[1)] | 3.6 | 7 | 14 | 29 | 62 |

[1)]Factor for the delay in time of an ageing effect at different temperatures in comparison with room temperature for ageing by dissolved carbon according to equation [1]

The quantity of description of the effect of dissolved nitrogen on steel ageing can be carried out similarly to the description of carbon ageing according to equation [1], using the coefficient of diffusion for nitrogen. The connection between ageing time and ageing temperature is therefore obtained as follows:

$$t_1(T_1)/t_2(T_2) = D(T_2)/D(T_1) = \frac{\exp(-18.33/(1,987\cdot 10^{-3}\cdot T_2)}{\exp(-18.33/(1,987\cdot 10^{-3}\cdot T_1)} \quad [2]$$

with $T_{1,2}$ in K.

Table 2 shows the factors calculated according to [2] for the delay in ageing effect caused by dissolved nitrogen.

TABLE 2

| Ageing temperature (° C.) | 10 | 5 | 0 | −5 | −10 |
|---|---|---|---|---|---|
| Factor[2)] | 3.1 | 5.5 | 14 | 19 | 36.5 |

[2)]Factor for the delay in time of an ageing effect at different temperatures in comparison with room temperature for ageing by dissolved nitrogen according to equation [2]

It is an object of the invention to provide a process for the ageing-free further processing of cold strips of an ageing-sensitive steel with high bake-hardening potential to produce a stove-finished structural component.

To resolve this problem the invention provides a process as set forth in claim 1 or a process as set forth in claim 3.

In the process according to claim 1 the ageing of dressed cold strip is suppressed by its storage at low temperature. In the alternative process set forth in claim 3, due to the bake-hardening effect triggered thereby the stove-finishing performed shortly after further shaping processing prevents the ageing of the cold strip dressed shortly prior to further processing.

To make use of the positive effect of a lowering of the surrounding temperature during the storage of cold strips, the storage temperature T in K (degrees Kelvin) can be estimated as follows, in dependence on the planned storage time in hours:

$$T=9225/(31.48-1n\ (48/t) \quad [3]$$

Equation [3] follows from equation [2] and relates to a steel which can no longer be satisfactorily processed, due to nitrogen ageing after exceeding a storage time of more than 2 days at 20° C. In the case of ageing by both elements, it is enough to allow for nitrogen only, due to the lower diffusion speed of carbon in comparison with nitrogen.

As an example, the change in material properties due to ageing at different temperatures was measured on a cold strip of a steel containing 0.003% C, 0.27% Mn, 0.003% Si, 0.007% P, 0.006% S, 0.046% A1, 0.001% N and Cu+Ni+Cr<0.1% (values in % by weight). After hot and cold rolling the steel was galvanised in a continuous fire-coating installation with a maximum annealing temperature of 820° C. and then subjected to 1.5% dressing. The difference between the upper and lower yield points ($R_{eh}$−$R_{el}$) was evaluated from the tensile test as a measure of the risk of stretcher strains.

FIG. 1 shows the development in time of $R_{eh}$−$R_{el}$ at room temperature, 60° C. and 100° C. Value $R_{eh}$−$R_{el}$=2 N/mm$^2$ can be regarded as the limit value for fault-free processing. With higher values than 2 N/mm$^2$ the occurrence of stretcher strains must be expected, since there is a marked drop in load in the stress/strain curve.

Figure 2:
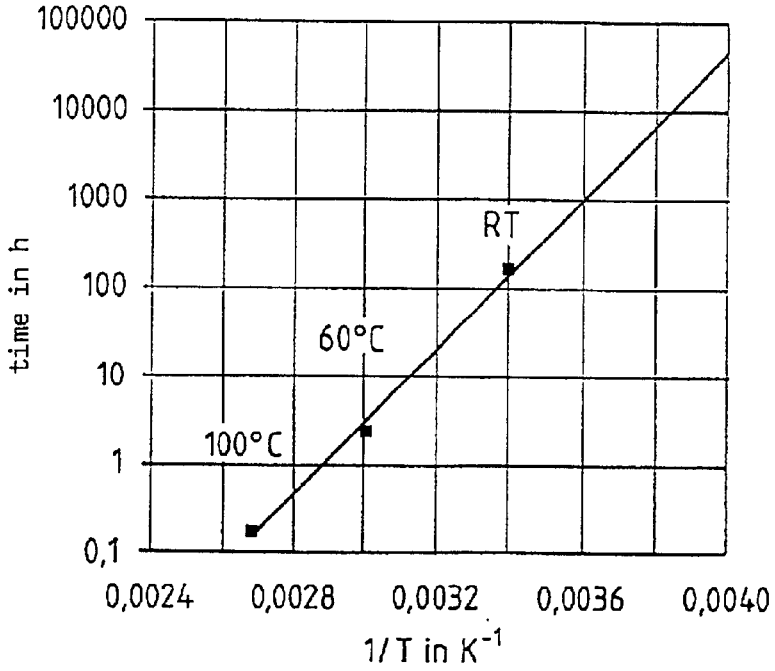

In FIG. 2 the associated time for reaching the value $R_{eh}$−$R_{el}$=2 N/mm$^2$ is plotted Arrhenius-fashion for each temperature. As in the case of all diffusion-controlled processes, the result in good approximation is a straight line.

The effect of a further lowering in temperature can be determined by lengthening the straight line with the values from Table 3.

TABLE 3

| Ageing temperature [° C.] | 30 | 20 | 5 | 0 | −5 | −10 |
|---|---|---|---|---|---|---|
| Ageing time[3)] [h] | 56 (2, 3 days) | 174 (7, 3 days) | 1118 (6, 7 wks) | 2170 (13 wks) | 4320 (26 wks) | 8830 (53 wks) |

While the critical value of ageing resistance is reached at 30° C. and 20° C. after 2 and 7 days respectively, processing free from stretch strains is ensured up to 13 weeks at 0° C. and even go up to one year at −10° C.

Table 4 lists the mechanical values of the steel, its 0.2% proof stress ($Rp_{0.2}$), tensile strength (Rm), elongation (A80), elongation without necking (Ag), the r value and its bake-hardening potential $BH_0$, and also the contents of dissolved C and N in the starting condition.

TABLE 4

| $Rp_{0.2}$ N/mm$^2$ | Rm N/mm$^2$ | A80 % | Ag % | r value | $BH_0$ N/mm$^2$ | $C_{diss.}$ ppm | $N_{diss.}$ ppm |
|---|---|---|---|---|---|---|---|
| 215 | 310 | 44 | 23.5 | 1.75 | 73 | 30 | <1 |

By the use of one of the two processes according to the invention a steel which has high contents of dissolved carbon and/or nitrogen and is notageing-resistant at room temperature can be further processed without the risk of surface faults even after a prolonged storage period.

The advantage of the process according to the invention lies in the utilisation of a high bake-hardening potential to produce steels from which structural components can be made which have higher buckling resistance in comparison with conventional bake-hardening steels resistant to ageing at room temperature.

What is claimed is:

1. A process for the production of a buckling resistant stove-finished structural component from a cold strip which comprises ageing-sensitive steel with a high bake-hardening potential, comprising the steps of:

converting the cold strip by temper rolling to a yield point elongation-free state in which the condition $R_{eh}-R_{el}<2$ N/mm$^2$ is met, storing the cold strip at storage temperature below room temperature for a storage-period whose length is at most equal to the length of the period at whose end the value of critical ageing is reached which results in dependence on the particular storage temperature, cold working the cold strip to give a structural component, and stove-finishing the structural component, wherein said bake-hardening potential is at least 70 N/mm$^2$.

2. A process according to claim 1, wherein the storage temperature T in [K] of the cold strip is selected in dependence on the planned storage time t in [h] in accordance with the equation $$T=9225/(31.48-1n\ (48t))$$

with T: storage temperature in [K]

T: storage time in [h].

3. A process for the production of a buckling-resistant stove-finished structural component from a cold strip which comprises ageing-sensitive steel with a bake-hardening potential, comprising the steps of:

storing the cold strip undressed for a storage period at room temperature, converting the cold strip by temper rolling to a state in which the condition $R_{eh}-R_{el}<2$ N/mm$^2$ is met, clod working the temper rolled cold strip to give a structural component, and stove-finishing the structural components wherein said bake-hardening potential is at least 70 N/mm$^2$.

* * * * *